US007854353B2

(12) United States Patent
Schmitz et al.

(10) Patent No.: US 7,854,353 B2
(45) Date of Patent: Dec. 21, 2010

(54) DEVICE FOR DISPENSING, ESPECIALLY ATOMIZING, A PREFERABLY COSMETIC LIQUID

(75) Inventors: Detlef Schmitz, Luenen (DE); Cristin Wirth, Hamburg (DE); Martin Wehmann, Hohenlockstedt (DE)

(73) Assignees: Seaquest Perfect Dispensing GmbH, Dortmund (DE); Beiersdorf AG, Hamburg (DE)

( * ) Notice: Subject to any disclaimer, the term of this patent is extended or adjusted under 35 U.S.C. 154(b) by 939 days.

(21) Appl. No.: 11/576,002

(22) PCT Filed: Sep. 22, 2005

(86) PCT No.: PCT/EP2005/010272

§ 371 (c)(1),
(2), (4) Date: Mar. 26, 2007

(87) PCT Pub. No.: WO2006/032506

PCT Pub. Date: Mar. 30, 2006

(65) Prior Publication Data

US 2007/0290002 A1 Dec. 20, 2007

(30) Foreign Application Priority Data

Sep. 24, 2004 (DE) ..... 10 2004 046 768

(51) Int. Cl.
*B65D 88/54* (2006.01)

(52) U.S. Cl. ..... 222/321.9; 222/39; 222/153.1; 222/321.8; 222/402.13; 239/333; 239/438

(58) Field of Classification Search ..... 222/39, 222/153.09–153.14, 321.1–321.9, 402.11, 222/402.13; 239/211, 333, 337, 357, 437–438
See application file for complete search history.

(56) References Cited

U.S. PATENT DOCUMENTS

| | | | | |
|---|---|---|---|---|
| 2,887,273 | A * | 5/1959 | Anderson et al. | 239/337 |
| 4,162,746 | A | 7/1979 | Anderson et al. | |
| 5,615,806 | A | 4/1997 | Grothoff | |
| 5,649,649 | A | 7/1997 | Marelli | |
| 6,000,633 | A * | 12/1999 | Lund et al. | 239/211 |
| 7,487,891 | B2 * | 2/2009 | Yerby et al. | 222/153.13 |

FOREIGN PATENT DOCUMENTS

| | | | |
|---|---|---|---|
| DE | 20215396 | U1 | 4/2003 |
| EP | 0 062 256 | A1 | 10/1982 |
| EP | 0098939 | A2 | 1/1984 |
| EP | 0187314 | A2 | 7/1986 |
| GB | 1509827 | | 5/1978 |

* cited by examiner

*Primary Examiner*—Kenneth Bomberg
*Assistant Examiner*—Andrew Bainbridge
(74) *Attorney, Agent, or Firm*—Roberts Mlotkowski Safran & Cole, P.C.; David S. Safran

(57) ABSTRACT

A device for dispensing, especially atomizing, a preferably cosmetic liquid has a dispensing head which can be manually depressed for dispensing of the liquid and can be turned to set the dispensing direction. In order to ensure simple and reliable handling, the device has a catch arrangement so that the dispensing head can be turned with a catching action. In a preferred embodiment, the catch arrangement has at least one catch cam, preferably several catch cams that are spaced in the direction of rotation. The catch cam or cams engage catch recesses with a catching action, especially radially relative to the actuation direction of the delivery head.

60 Claims, 3 Drawing Sheets

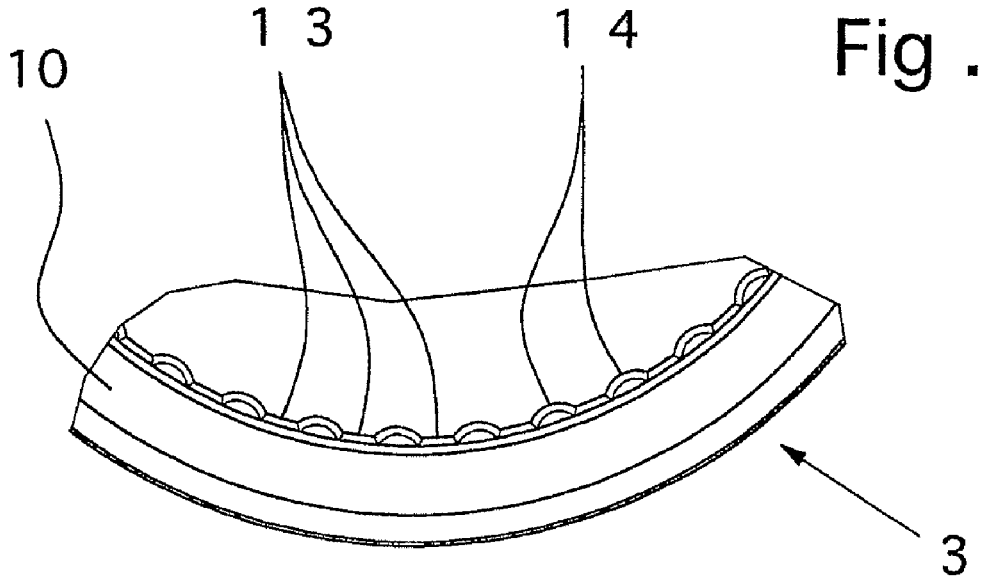
Fig. 4
Fig. 5
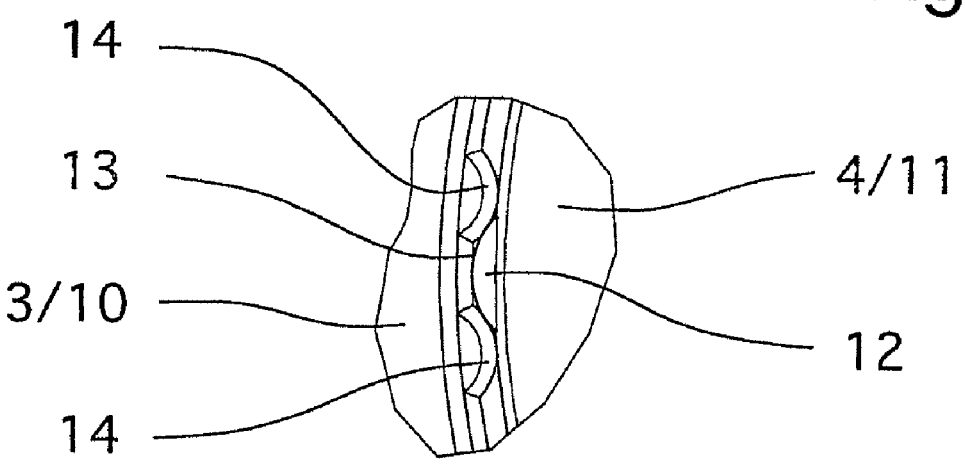

DEVICE FOR DISPENSING, ESPECIALLY ATOMIZING, A PREFERABLY COSMETIC LIQUID

BACKGROUND OF THE INVENTION

1. Field of the Invention

This invention relates to a device for dispensing, especially atomizing, a preferably cosmetic liquid with a bottom part and a dispensing head which can be turned manually relative to the bottom part for adjusting the dispensing direction and can be depressed manually in one actuation direction for dispensing of liquid, and to the use of such a device.

2. Description of Related Art

The concept of "cosmetic liquid" includes, in a narrow sense, hair spray, hair lacquer, a deodorant, a foam, a gel, a coloring spray, a sunscreen, skin care agent, cleaning agent or the like. Preferably, in a wider sense, also other body care products, cleaning products, cosmetics, or the like, and also suspensions and fluids, especially with gaseous phases, are included. But, other liquids, for example, air fresheners, and especially also technical liquids and fluids, such as rust looseners or the like, can also be used. However, for reasons of simplification and based on the focus of use, only cosmetic liquids are addressed below.

A device for atomizing of sunscreen is known from practice. The device is made as an atomizer pump and is screwed with a bottom part onto a container which contains the sunscreen. It has a dispensing head which can be depressed against spring force in the actuation direction. The sunscreen is dispensed upon depression, and in doing so, is sprayed in the nozzle of the dispensing head. The dispensing head can turn around an axis of rotation in the actuation direction. This allows the desired alignment of the spray direction of the dispensing head relative to the bottom part and this relative to the tank. This is advantageous for especially non-rotationally symmetrical containers and allows user-friendly alignment. As a result of the screw connection, specifically a defined rotary position of the device and its bottom part to the container is not ensured. Rather, production tolerances lead to different relative rotary positions so that an individual alignment of the dispensing head, and thus of the dispensing direction, is desirable, but the problem is that the relatively small and often almost rotationally symmetrical, especially cylindrical dispensing head can twist in an undesirable manner so that, when the device is being used, it often dispenses in an unwanted dispensing direction if the user does not pay careful attention to the alignment of the dispensing head.

SUMMARY OF THE INVENTION

The object of this invention is to devise a device for dispensing, especially atomizing, of a preferably cosmetic liquid and use of such a device with improved manageability.

This object is achieved by a device of the initially mentioned type in which the device has a catch means so that the dispensing head can be turned relative to the bottom part with a catching action.

The basic idea of this invention is to provide a catch means so that the dispensing head can be turned relative to the bottom part especially exclusively with a catching action. This greatly facilitates handling of the device of the invention since the dispensing head no longer turns in unwanted directions, but remains in the desired rotary position relative to the bottom part, and thus, relative to the container which is assigned to the device and which contains the liquid to be dispensed, as a result of the action of the catch means. Unintentional turning of the dispensing head can thus essentially be completely eliminated.

Preferably, the required force for turning the dispensing head against the force of the catch means from one catch to the next catch is selected such that, on the one hand, a user-friendly ease of movement is possible, and on the other, a stiffness sufficient to prevent unwanted twisting is achieved.

Especially preferably, the catch means is formed by the interaction of the dispensing head with the bottom part. Preferably, for this purpose, catch cams are located or molded on the dispensing head and catch recesses on the bottom part or vice versa. The catch cams and catch recesses radially engage one another, and thus, form the catch means with other catch steps in the direction of rotation, and which can move axially relative to one another in the actuation direction of the dispensing head. Therefore, the catching action is preserved even when the dispensing head is actuated. Thus, the desired catch function is enabled in a very simple and economical manner, especially without additional parts.

The device with the catch function in accordance with the invention can be used in a versatile manner. For example, the device can be made especially as an atomizer pump. However, the device can also be made as a metering dispenser or as a dispensing valve with a spray head for a spray or the like.

The device for dispensing and if necessary atomizing a cosmetic liquid is used especially preferably in the initially indicated sense.

Other advantages, features, properties and aspects of this invention will become apparent from the following description of a preferred embodiment with reference to the accompanying drawings.

BRIEF DESCRIPTION OF THE DRAWINGS

FIG. 4 shows an extract top view of the bottom part; and

FIG. 5 shows an extract of the catch means which is formed by the dispensing head and the bottom part.

DETAILED DESCRIPTION OF THE INVENTION

The same reference numbers are used for the same or similar parts in the figures, the corresponding or comparable properties and advantages being achieved even if a repeated description is omitted.

Figure 1:
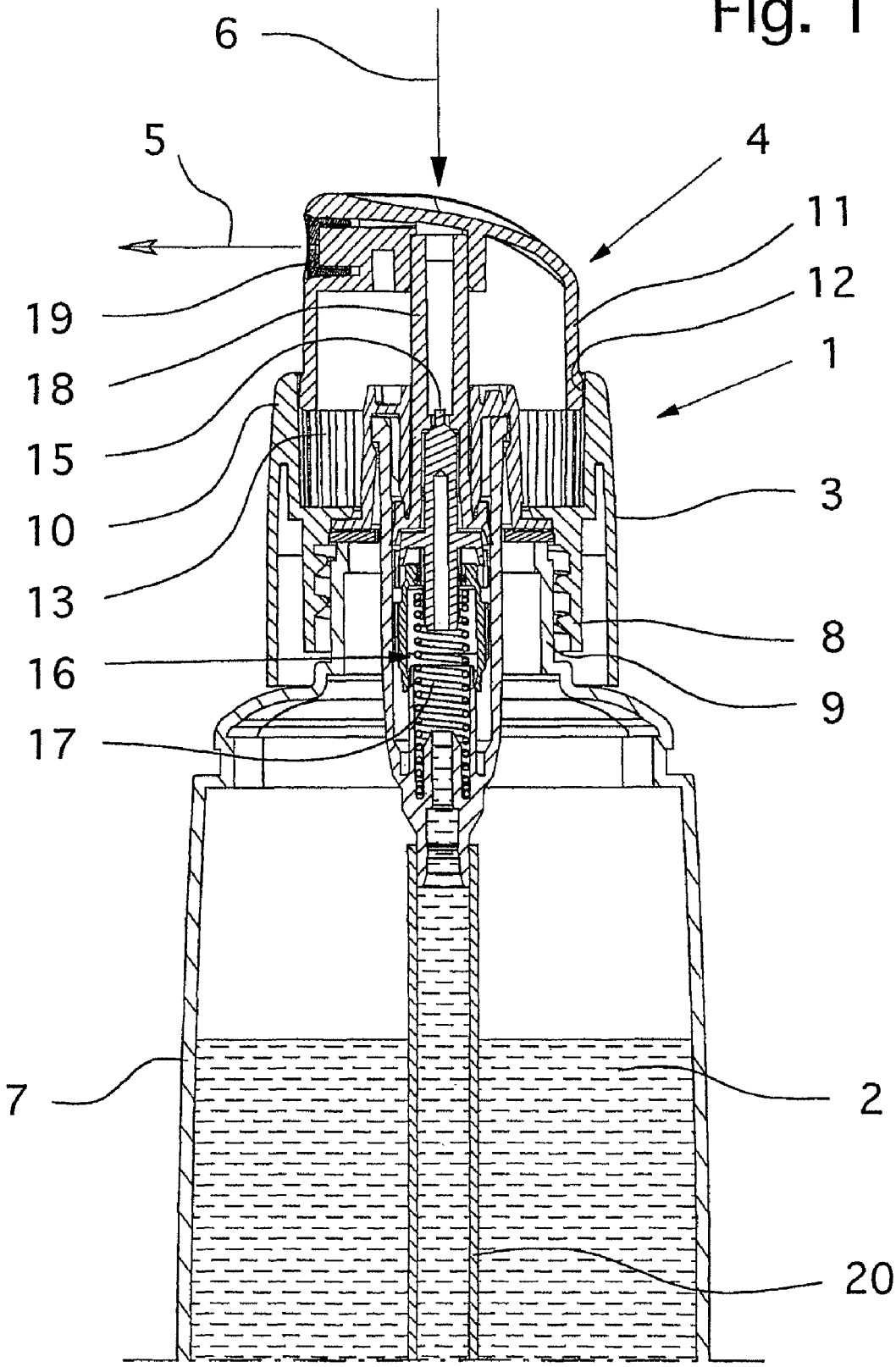
FIG. 1 shows a schematic section of a device in accordance with the invention with a dispensing head and a bottom part which is screwed onto an assigned container.

FIG. 1 shows, in a schematic section, a device 1 in accordance with the invention for dispensing, especially atomizing of a preferably cosmetic liquid 2 or the like.

The device 1 has a bottom part 3 and a dispensing head 4, which can be manually turned relative to the bottom part 3 in order to be able to set the dispensing direction 5 indicated in FIG. 1. For dispensing and especially atomizing of the liquid 2, the dispensing head 4 can be depressed or moved manually in the indicated actuation direction 6.

The axis of rotation of the dispensing head 4 runs preferably at least essentially in the actuation direction 6. If necessary, the axis of rotation, however, can also be inclined relative thereto or can even run transversely thereto.

The dispensing direction 5 runs preferably crosswise, especially at least essentially perpendicular to the actuation direction 6.

The device 1 is or can be connected preferably in a rotationally fixed manner to a container 7 which contains or holds the liquid 2. To do this, in the illustrated example, the bottom part 3 has a threaded section 8 which is screwed onto the neck 9 of the container 7 as shown in FIG. 1. Accordingly, the device 1 or its bottom part 3, in the state of use, is connected to the container 7 in a rotationally fixed manner.

Based on production tolerances, the specific rotary position of the bottom part 3 relative to the container 7 however cannot be predicted or can be predicted only very inaccurately in the screwed-on, tightened state. Accordingly, the above explained rotational capacity of the dispensing head 4 is desirable or even necessary for adjustment of the dispensing direction 5, especially for a non-rotationally symmetrical execution of the assigned container 7, in order to enable ergonomically efficient handling.

However, the device 1 and its bottom part 3 can also be connected detachably or nondetachably in some other way to the container 7.

The bottom part 3, in the illustrated example, is preferably made in one piece. However, if necessary, it can also be made in several parts.

In particular, depending on the execution of the container 7, the bottom part 3 is made preferably at least essentially rotationally symmetrical, or in contrast thereto, is adapted to an especially non-rotationally symmetrical shape of the container 7.

The bottom part 3, in the illustrated example, forms a preferably annular section 10 which the dispensing head 4 engages especially with a preferably hollow cylindrical guide section 11. If necessary, the section 10 can be used to guide the dispensing head 4, especially when it moves in the actuation direction 6.

In accordance with the invention, the device 1 has a catch means so that the dispensing head 4 can be turned relative to the bottom part 3 preferably exclusively with a catching action. In the illustrated example, the catch means acts directly between the bottom part 3 and the dispensing head 4 and is formed especially by the bottom part 3 and/or the dispensing head 4. Especially preferably, the catch means is located on the preferably annular section 10 and guide section 11 and is formed by them.

Figure 2:
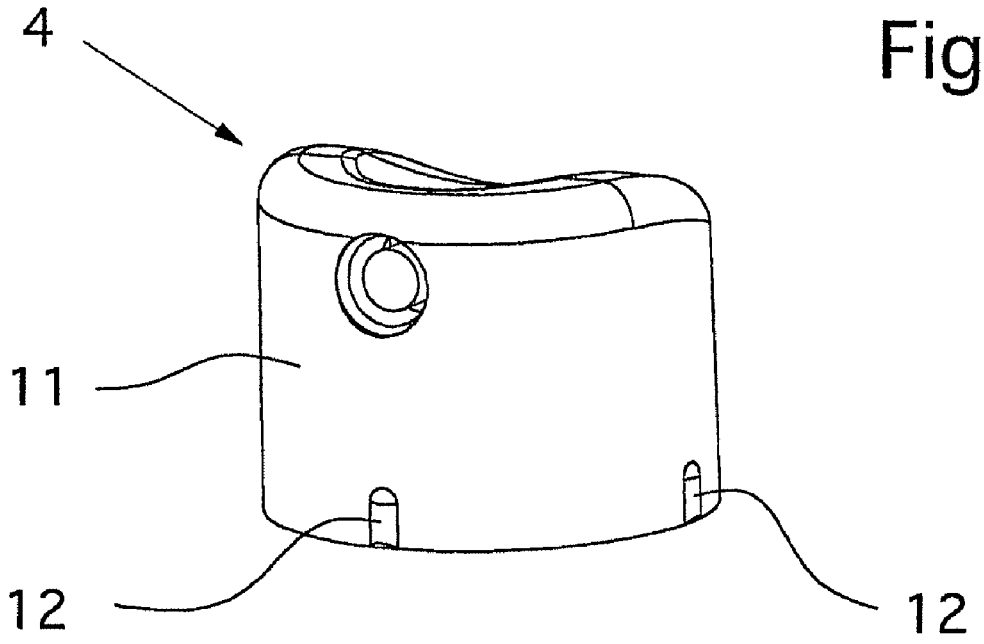
FIG. 2 is a perspective view of the dispensing head.
Figure 3:
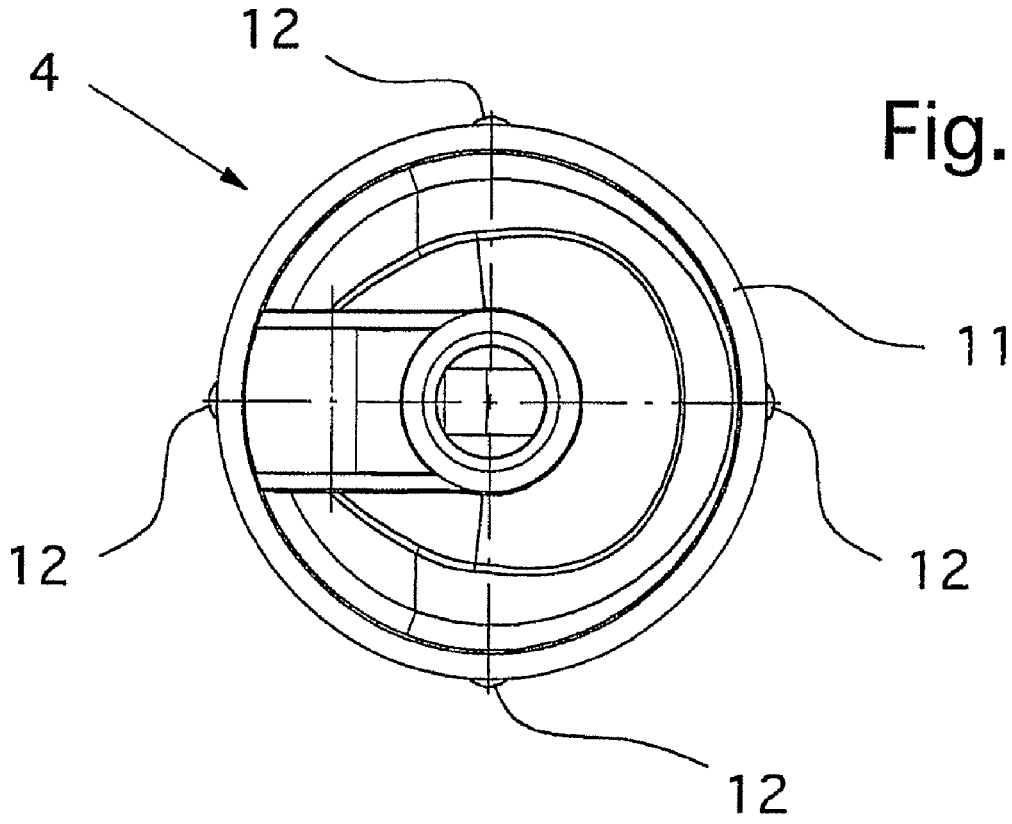
FIG. 3 is a bottom view of the dispensing head.

The catch means, in the illustrated example, comprises at least one catch cam 12, preferably several catch cams 12, which are spaced in the direction of rotation or peripheral direction, as can be taken from the perspective view of the dispensing head 4 shown in FIG. 2 and the bottom view of the dispensing head 4 of FIG. 3. The catch cams 12 here project radially on the outer side of the discharge head 4 and of the guide section 11. The catch cams 12 are located on the bottom end of the dispensing head 4 or guide section 11, therefore the end facing the bottom part 3, and are uniformly distributed around the periphery in the illustrated example. In particular, there are only four catch cams 12 here.

The catch cams 12 are made relative short in the axial direction, therefore, in the actuating direction 6. But, the catch cams 12 can also extend longer, especially in the manner of a crosspiece, in the actuating direction 6 of the dispensing head 4.

The catch means, in the illustrated example, also comprises at least one catch recess 13, preferably several catch recesses 13 distributed or spaced in the direction of rotation, on the bottom part 3, especially on the inside of the annular section 10 of the bottom part 3. In the illustrated example, the catch recesses 13 are preferably made groove-like in the axial direction or actuating direction 6. The catch recesses 13 or projections or crosspieces 14 located in between form more or less peripheral teeth.

The catch cams 12 and catch recesses 13 are matched to one another or are made complementary to one another such that the catch projections 12 can engage one another with a catching action, especially radially relative to the actuating direction 6 of the dispensing head 4, the dispensing head 4 being pivotable relative to the bottom part 3 as it catches.

The extract shown in FIG. 5 illustrates how the catch cams 12 radially engages the catch recess 13 or between two crosspieces 14.

Therefore, in the locked state, positive locking is formed by the catch means and the engaging catch cams 12 and prevents turning of the dispensing head 4 relative to the bottom part 3. However, this positive locking can be overcome by a correspondingly strong turning of the dispensing head 4.

In order to achieve the desired catch behavior, therefore sufficient tightness, to prevent unwanted twisting of the dispensing head 4, but also to enable sufficient ease of rotation of the dispensing head 4 for the user, the catch means is made accordingly. In particular, the profiles of the catch cams 12 and the catch recesses 13 or crosspieces 14 are matched to one another in a suitable manner, in the illustrated example, the catch cams 12 and the crosspieces or projections 14 which rise between the catch recesses 13 are rounded or made largely uniformly arched. Furthermore, especially the number of catch elements engaging at the same time in the catch position, in the illustrated example, fixed by the number of catch cams 12, is selected accordingly; preferably there are at least two and at most six simultaneous engagement sites, in the illustrated example, four engagement sites result from the four catch cams 12. Moreover, to achieve the desired catch properties, the catch cams 12 and/or the crosspieces 14 between the catch recesses 13, can each be radially deformed elastically and/or located on a radially elastically resilient section 10, 11. This can be achieved by the corresponding material selection and dimensioning.

Instead of the catch recesses 13, of course, also the projections or crosspieces 14 can be regarded as opposing elements for the catch cams 12 to achieve the desired catch function.

Furthermore, a kinematic reversal or functional reversal is, of course, possible. For example, the catch cams 12 can also be formed on the bottom part 3 and the catch recesses 13 on the dispensing head 4. Furthermore, the catch means can also be located or formed between the outer surface of the bottom part 3 and the inner surface of the dispensing head 4.

Moreover, the catch means can also act, for example, only indirectly between the bottom part 3 and the dispensing head 4, for example, by interposition of at least one additional component.

The catch means is made preferably such that an at least largely play-free locking is attained.

The catch means is preferably made such that the dispensing head 4, after release, always assumes a locked rotary position, the catch means, therefore, especially due to the shape and elasticity of the participating components locking in automatically.

The catch means, especially its catch cams 12 and catch recesses 13, is or are arranged or made, in the illustrated example, such that the catch function acts over the entire actuating distance of the dispensing head 4, therefore in each depressed position of the dispensing head 4.

The device 1, especially the catch means, is necessarily made such that the dispensing head 4 can be turned only in the non-depressed state. This can be achieved, for example, in that the engagement depth of the catch cams 12 between the crosspieces and projections 14, in the depressed state, is enlarged such that further locking into the next catch position is no longer possible.

The catch means is made such that the dispensing head 4 can be turned in several catch steps, preferably of less than 20°, especially less than 15°, preferably roughly 8° to 12°, relative to the bottom part 3. These catch steps are established in the illustrated example by the distances of the catch recesses 13.

If necessary, the dispensing head 4 can be turned only to a limited degree, therefore only twisted in a limited angular range. This is an especially good idea when the dispensing head 4 can be turned into a blocked position in which the dispensing head 4 is blocked against actuation or depression. This blocked position is then reached especially on one end of the rotary angle region or if necessary also on the two ends of the rotary angle region.

In order to achieve a compact construction, the dispensing head 4 is made preferably at least essentially cylindrical and/or rotationally symmetrical.

The device 1 preferably has an outlet valve 15 which can be opened by pressing down the dispensing head 4 and/or by a pump 16 which can be actuated by pressing it down for the liquid 2. In particular the device 1 is made as an atomizer pump. But the device 1, as already mentioned above, can also be a so-called metering dispenser or an aerosol valve, for example, for a pressurized container or the like.

The device in the illustrated example has a reset means in the form of a spring 17, against the force of which the dispensing head 4 can be actuated.

In the illustrated example, the device 1 has a connecting piece 18 onto which the dispensing head 4 is slipped axially, therefore in the actuation direction 6, during mounting. In this mounting, the catch cams 12 and catch recesses 13 or crosspieces 14 are pushed axially into one another and automatically engaged. In order to ensure ease of assembly, there are preferably the corresponding insertion bevels or roundings on the front sides of the catch cams 12 and/or crosspieces 14 facing the bottom part 3 or dispensing head 4.

According to one version, which is not shown, with the corresponding limitation of the catch recesses 13 on the free axial end of the section 10, the catch cams 12 and catch recesses 13 can also extend behind one another such that an axial stop for the mounted dispensing head 4 is formed so that the dispensing head 4 is locked against unwanted loosening from the bottom part 3. The corresponding insertion bevel or rounding of the catch cam 12 enables assembly, release of the dispensing head 4 conversely is necessarily excluded.

The operation of the device 1 which is made as an atomizer pump, in the illustrated example, is briefly described below.

When the dispensing head 4 is actuated or pressed down in the actuating direction 6 against the force of the spring 17, the liquid 2 in the pump 16 is compressed and dispensed via the connecting piece 18 and corresponding channels in the dispensing head 4 and preferably a nozzle 19 in the dispensing direction 5 and in doing so is preferably atomized. The dispensing head 4 is then reset into its initial position automatically by the force of the spring 17, in doing so, liquid 2 being taken into the pump 16 via a line or a tube 20. To enable the pump to work, an inlet valve (not shown), and for example, the already named outlet valve 15 interact in a suitable manner.

As already explained, the device 1 in accordance with the invention can be used especially for cosmetic liquids 2 in the initially named sense, but also for other liquids.

What is claimed is:

1. Device for dispensing a liquid, comprising, a bottom part, a dispensing head which is manually turnable relative to the bottom part for adjusting a dispensing direction and which is manually depressible in an actuation direction for dispensing of liquid, and a catch means for providing a catching action during turning of the dispensing head relative to the bottom part which acts to hold the dispensing head in a position to which it has been turned, wherein the catch means has at least one catch cam, wherein the catch means comprises at least one catch recess, wherein the at least one catch cam engages the at least one catch recess with a catching action, and wherein the at least one catch cam and the catch recesses are axially pushable into or axially moveable relative to one another in the actuation direction.

2. Device as claimed in claim 1, wherein the bottom part is connected to a container which holds the liquid by means of a threaded section.

3. Device as claimed in claim 1, wherein the bottom part is made of a one-piece construction.

4. Device as claimed in claim 1, wherein the bottom part is at least essentially rotationally symmetric.

5. Device as claimed in claim 1, wherein the bottom part has an annular section which the dispensing head engages.

6. Device as claimed in claim 1, wherein the catch means acts between the bottom part and the dispensing head.

7. Device as claimed in claim 6, wherein the bottom part has an annular section which the dispensing head engages; and wherein the catch means is formed by the interaction of the annular section and of a guide section of the dispensing head.

8. Device as claimed in claim 1, wherein the catch means has at least one catch cam.

9. Device as claimed in claim 1, wherein the catch means has a plurality of catch cams that are circumferentially spaced from one another.

10. Device as claimed in claim 8, wherein the at least one catch cam is located on the dispensing head and interacts with the bottom part.

11. Device as claimed in claim 10, wherein the at least one catch cam is one of radially deformable elastically and located on a radially elastically resilient section.

12. Device as claimed in claim 9, wherein the at least one catch cams extends in the actuation direction of the dispensing head.

13. Device as claimed in claim 8, wherein the catch means has a plurality of catch recesses which are circumferentially spaced from one another and which form peripheral teeth.

14. Device as claimed in claim 13, wherein the catch recesses are located on the bottom part.

15. Device as claimed in claim 13, wherein the catch recesses form projections which are one of radially elastically deformable and located on a radially elastically resilient section.

16. Device as claimed in claim 13, wherein the catch recesses are grooves that extend in the actuation direction of the dispensing head.

17. Device as claimed in claim 1, wherein the catch means act with a catching action in each actuation position of the dispensing head.

18. Device for dispensing a liquid, comprising, a bottom part, a dispensing head which is manually turnable relative to the bottom part for adjusting a dispensing direction and which is manually depressible in an actuation direction for dispensing of liquid, and a catch means for providing a catching action during turning of the dispensing head relative to the bottom part which acts to hold the dispensing head in a position to which it has been turned, wherein the catch means form an axial stop which prevents axial loosening of the dispensing head from the bottom part.

19. Device as claimed in claim 1, wherein the dispensing head is turnable only in a non-depressed state.

20. Device for dispensing a liquid, comprising, a bottom part, a dispensing head which is manually turnable relative to the bottom part for adjusting a dispensing direction and which is manually depressible in an actuation direction for dispensing of liquid, and a catch means for providing a catching action during turning of the dispensing head relative to the bottom part which acts to hold the dispensing head in a position to which it has been turned, wherein the dispensing head is turnable in catch steps of less than 20° each.

21. Device as claimed in claim 1, wherein the dispensing head is turnable only by a limited rotary angle range.

22. Device as claimed in claim 1, wherein the dispensing head is at least essentially cylindrical.

23. Device as claimed in claim 1, wherein the dispensing direction of the dispensing head runs at least essentially perpendicular to its actuation direction.

24. Device as claimed in claim 1, wherein the axis of rotation of the dispensing head runs at least essentially in its actuation direction.

25. Device as claimed in claim 1, further comprising an outlet valve which is opened by pressing down on the dispensing head.

26. Device as claimed in claim 1, further comprising a pump that is actuated by pressing down on the dispensing head.

27. Device as claimed in claim 1, wherein the pump is an atomizer pump.

28. Device as claimed in claim 1, wherein the liquid is one of a hair spray, a hair lacquer, a deodorant, a foam, a gel, a coloring spray, a sunscreen, a skin care agent, a cleaning agent and an air freshener, the liquid being dispensable by depressing the dispensing head while it is being held in a desired rotational position relative to the bottom part by the catching means.

29. Device as claimed in claim 18, wherein the bottom part is connected to a container which holds the liquid by means of a threaded section.

30. Device as claimed in claim 18, wherein the bottom part is made of a one-piece construction.

31. Device as claimed in claim 18, wherein the bottom part is at least essentially rotationally symmetric.

32. Device as claimed in claim 18, wherein the bottom part has an annular section which the dispensing head engages.

33. Device as claimed in claim 18, wherein the catch means acts between the bottom part and the dispensing head.

34. Device as claimed in claim 33, wherein the bottom part has an annular section which the dispensing head engages; and wherein the catch means is formed by the interaction of the annular section and of a guide section of the dispensing head.

35. Device as claimed in claim 18, wherein the catch means has at least one catch cam.

36. Device as claimed in claim 35, wherein the at least one catch cam is located on the dispensing head and interacts with the bottom part.

37. Device as claimed in claim 18, wherein the catch means has a plurality of catch cams that are circumferentially spaced from one another.

38. Device as claimed in claim 35, wherein the at least one catch cam is one of radially deformable elastically and located on a radially elastically resilient section.

39. Device as claimed in claim 35, wherein the at least one catch cams extends in the actuation direction of the dispensing head.

40. Device as claimed in claim 35, wherein the catch means has a plurality of catch recesses which are circumferentially spaced from one another and which form peripheral teeth.

41. Device as claimed in claim 40, wherein the catch recesses are located on the bottom part.

42. Device as claimed in claim 40, wherein the catch recesses form projections which are one of radially elastically deformable and located on a radially elastically resilient section.

43. Device as claimed in claim 40, wherein the catch recesses are grooves that extend in the actuation direction of the dispensing head.

44. Device as claimed in claim 35, wherein the catch means act with a catching action in each actuation position of the dispensing head.

45. Device as claimed in claim 20, wherein the bottom part is connected to a container which holds the liquid by means of a threaded section.

46. Device as claimed in claim 20, wherein the bottom part is made of a one-piece construction.

47. Device as claimed in claim 20, wherein the bottom part is at least essentially rotationally symmetric.

48. Device as claimed in claim 20, wherein the bottom part has an annular section which the dispensing head engages.

49. Device as claimed in claim 20, wherein the catch means acts between the bottom part and the dispensing head.

50. Device as claimed in claim 48, wherein the bottom part has an annular section which the dispensing head engages; and wherein the catch means is formed by the interaction of the annular section and of a guide section of the dispensing head.

51. Device as claimed in claim 20, wherein the catch means has at least one catch cam.

52. Device as claimed in claim 51, wherein the at least one catch cam is located on the dispensing head and interacts with the bottom part.

53. Device as claimed in claim 20, wherein the catch means has a plurality of catch cams that are circumferentially spaced from one another.

54. Device as claimed in claim 51, wherein the at least one catch cam is one of radially deformable elastically and located on a radially elastically resilient section.

55. Device as claimed in claim 51, wherein the at least one catch cams extends in the actuation direction of the dispensing head.

56. Device as claimed in claim 51, wherein the catch means has a plurality of catch recesses which are circumferentially spaced from one another and which form peripheral teeth.

57. Device as claimed in claim 40, wherein the catch recesses are located on the bottom part.

58. Device as claimed in claim 40, wherein the catch recesses form projections which are one of radially elastically deformable and located on a radially elastically resilient section.

59. Device as claimed in claim 40, wherein the catch recesses are grooves that extend in the actuation direction of the dispensing head.

60. Device as claimed in claim 51, wherein the catch means act with a catching action in each actuation position of the dispensing head.

* * * * *